US008661718B2

(12) United States Patent
Scicluna

(10) Patent No.: US 8,661,718 B2
(45) Date of Patent: Mar. 4, 2014

(54) REMOVABLE INITIAL PATCH

(75) Inventor: Paul Victor Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 12/968,981

(22) Filed: Dec. 15, 2010

(65) Prior Publication Data

US 2011/0083349 A1 Apr. 14, 2011

Related U.S. Application Data

(63) Continuation of application No. 12/031,903, filed on Feb. 15, 2008, now Pat. No. 7,874,087.

(51) Int. Cl.
*A44C 3/00* (2006.01)

(52) U.S. Cl.
USPC ..... 40/1.5; 40/661.11

(58) Field of Classification Search
USPC ..... 40/1.5, 6, 661.04, 661.05, 661.11, 668
See application file for complete search history.

(56) References Cited

U.S. PATENT DOCUMENTS

| | | | | |
|---|---|---|---|---|
| 808,867 | A | 1/1906 | Perry | |
| 2,455,588 | A * | 12/1948 | Kotzin | 2/248 |
| 2,863,235 | A | 12/1958 | Krause | |
| 5,359,734 | A * | 11/1994 | Rathburn | 2/195.1 |
| 6,178,680 | B1 * | 1/2001 | Sloot | 40/668 |
| 6,675,512 | B1 | 1/2004 | Schwartz et al. | |
| 7,874,087 | B2 | 1/2011 | Scicluna | |
| 2005/0102876 | A1 * | 5/2005 | Kelly | 40/661.04 |
| 2005/0145458 | A1 | 7/2005 | Cohen | |
| 2006/0117617 | A1 | 6/2006 | Peterson et al. | |
| 2008/0141567 | A1 * | 6/2008 | Chen | 40/1.5 |

OTHER PUBLICATIONS

U.S. Appl. No. 12/031,903, Dec. 15, 2010 Issue Fee payment.
U.S. Appl. No. 12/031,903, Sep. 22, 2010 Notice of Allowance.
U.S. Appl. No. 12/031,903, Aug. 25, 2010 Response to Final Office Action.
U.S. Appl. No. 12/031,903, Jun. 25, 2010 Final Office Action.
U.S. Appl. No. 12/031,903, Jun. 8, 2010 Response to Non-Compliant.
U.S. Appl. No. 12/031,903, Jun. 4, 2010 Non-Compliant.
U.S. Appl. No. 12/031,903, May 26, 2010 Response to Non-Final Office Action.
U.S. Appl. No. 12/031,903, Apr. 1, 2010 Non-Final Office Action.
U.S. Appl. No. 12/031,903, Jan. 5, 2010 Response to Restriction Requirement.
U.S. Appl. No. 12/031,903, Dec. 17, 2009 Restriction Requirement.

* cited by examiner

*Primary Examiner* — Gary Hoge
(74) *Attorney, Agent, or Firm* — Jon Fallon, Esq.

(57) ABSTRACT

The present invention relates to the field of luggage identification tags, and in particular, to a removable identification patch in which indicia can be incorporated onto the patch prior to installation of the patch onto the piece of luggage. A fastening plate is positioned on the interior surface of the luggage and is securely coupled to the identification patch, which is positioned on the exterior surface of the luggage. In one embodiment, the identification patch is attached directly to the fastening plate through fasteners that extend through the luggage wall. In another embodiment, the fastening plate includes projecting tabs which extend through the luggage wall to matingly engage a housing member positioned on the exterior surface of the luggage. The housing member includes a cavity for receiving the identification patch. The identification patch can be removed from the luggage and replaced with an alternative or second identification patch.

7 Claims, 6 Drawing Sheets

REMOVABLE INITIAL PATCH

CROSS-REFERENCE TO RELATED APPLICATIONS

This application is a continuation of U.S. patent application Ser. No. 12/031,903, filed on Feb. 15, 2008, now U.S. Pat. No. 7,874,087 the entire contents of which is expressly incorporated herein by reference thereto.

BACKGROUND OF THE INVENTION

1. Field of the Invention

The present invention relates to the field of luggage identification tags. Particularly, the present invention is directed to a removable identification patch in which indicia, for example an owner's initials, can be incorporated onto the patch prior to installation of the patch onto the piece of luggage.

2. Description of Related Art

The luggage industry has been successful in refining its products to resist damage, protect travelers' possessions, meet carrier and governmental regulations regarding luggage shape and size, and to standardize luggage manufacturing processes. Furthermore, consumers seek a durable product that resists the unavoidably rough handling experienced during travel, and one that does not show the marks and dirt inevitably associated with cargo holds, transport devices and the hands of luggage personnel. Consequently, most luggage, regardless of the manufacturer, are remarkably similar in shape, size and color.

In many cases, the only way that a particular luggage item can be identified is by looking at a personal identification tag, which often cannot be viewed until the luggage item is so close as to make it difficult to both identify the item and retrieve it from the carousel before it moves out of reach. Moreover, the tags of some luggage suppliers have windows for personal ID cards that are covered by flaps to ensure the anonymity of the owner. In those instances, the traveler has to open the flap and view the ID card in order to identify his/her luggage item which makes it all the more difficult to identify and retrieve the item.

Such conventional methods and systems generally have been considered satisfactory for their intended purpose. However, these tags are particularly prone to being lost or damaged during the luggage handling processes. This is especially true as more carriers begin using sophisticated optical scanning systems that require the luggage to be rotated about its axis thus exposing it to an increase in friction forces and greater likelihood of accidental snagging from the conveyor belts. Such automated sorting systems are particularly prone to tearing traditional identification tags from luggage. As a result, the owner may not be able to properly identify their luggage in the event the identification tag has been torn away. Further, the luggage itself may be damaged upon the forcible tearing away of the identification tag.

Furthermore, identification tags which are permanently attached to the luggage prior to the printing of the owners information onto the tag are subject to numerous disadvantages. For example, such designs require that the entire piece of luggage be maneuvered into position with respect to a stencil of the printing apparatus. However, the significant size and weight of many commercial luggage items complicates, and indeed may even prohibit, the proper placement of the identification tag with respect to the printing apparatus. Moreover, in the event that an error is made in the printing, or the owner is otherwise unsatisfied with the appearance of the identification patch, the removal and reworking of the patch may involve substantial effort and require special equipment. In some designs, removal of the patch will not be possible, resulting in the entire piece of luggage being discarded and significant costs being absorbed by the manufacturer.

There thus remains a need for an efficient and more effective method and system for securely attaching an identification patch to luggage.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied and broadly described, the invention includes a luggage identification device comprising a fastening member and an identification patch removably coupled to the fastening member. In accordance with an aspect of the invention, the fastening member is disposed on an interior surface of the luggage while the identification patch is disposed on an exterior surface of the luggage.

In an exemplary embodiment, the fastening member is configured as a generally planar plate, and includes a plurality of apertures. Additionally, the identification patch includes a plurality of retention features configured to correspond with the plurality of apertures in the fastening member, when the identification patch is coupled to the luggage. To join the identification patch to the luggage, fasteners (e.g. screws, nails, tacks, etc.) are inserted through the apertures to matingly engage the retention features thereby coupling the fastening member to the identification patch. In an exemplary embodiment, the identification patch includes personalized indicia, such as the owner's initials. Furthermore, the identification patch can be removed from the fastening member, such that a second (i.e. different) identification patch can be coupled to the fastening member and attached to the luggage. Typically, the fastening member is made of metal, and the identification patch is made of leather.

In another embodiment of the invention, the luggage identification device comprises a fastening member, a housing coupled to the fastening member, and an identification patch removably coupled to the housing. The fastening member is disposed on an interior surface of the luggage while the housing and identification patch are disposed on an exterior surface of the luggage. Additionally, the housing includes a plurality of apertures and the fastening member includes a plurality of retention features. The housing apertures are arranged to receive the retention features of the fastening member to thereby couple the housing to the fastening member. In some applications, the retention features are configured as projecting tabs.

The housing includes a generally planar surface with a raised border extending around the periphery of the generally planar surface to define a cavity therein. Typically, the housing cavity is sized such that the identification patch can be disposed within the cavity.

It is to be understood that both the foregoing general description and the following detailed description are exemplary and are intended to provide further explanation of the invention claimed.

The accompanying drawing, which is incorporated in and constitutes part of this specification, is included to illustrate and provide a further understanding of the method and system of the invention. Together with the description, the drawing serves to explain the principles of the invention.

DETAILED DESCRIPTION OF AN EXEMPLARY EMBODIMENT

Figure 1:
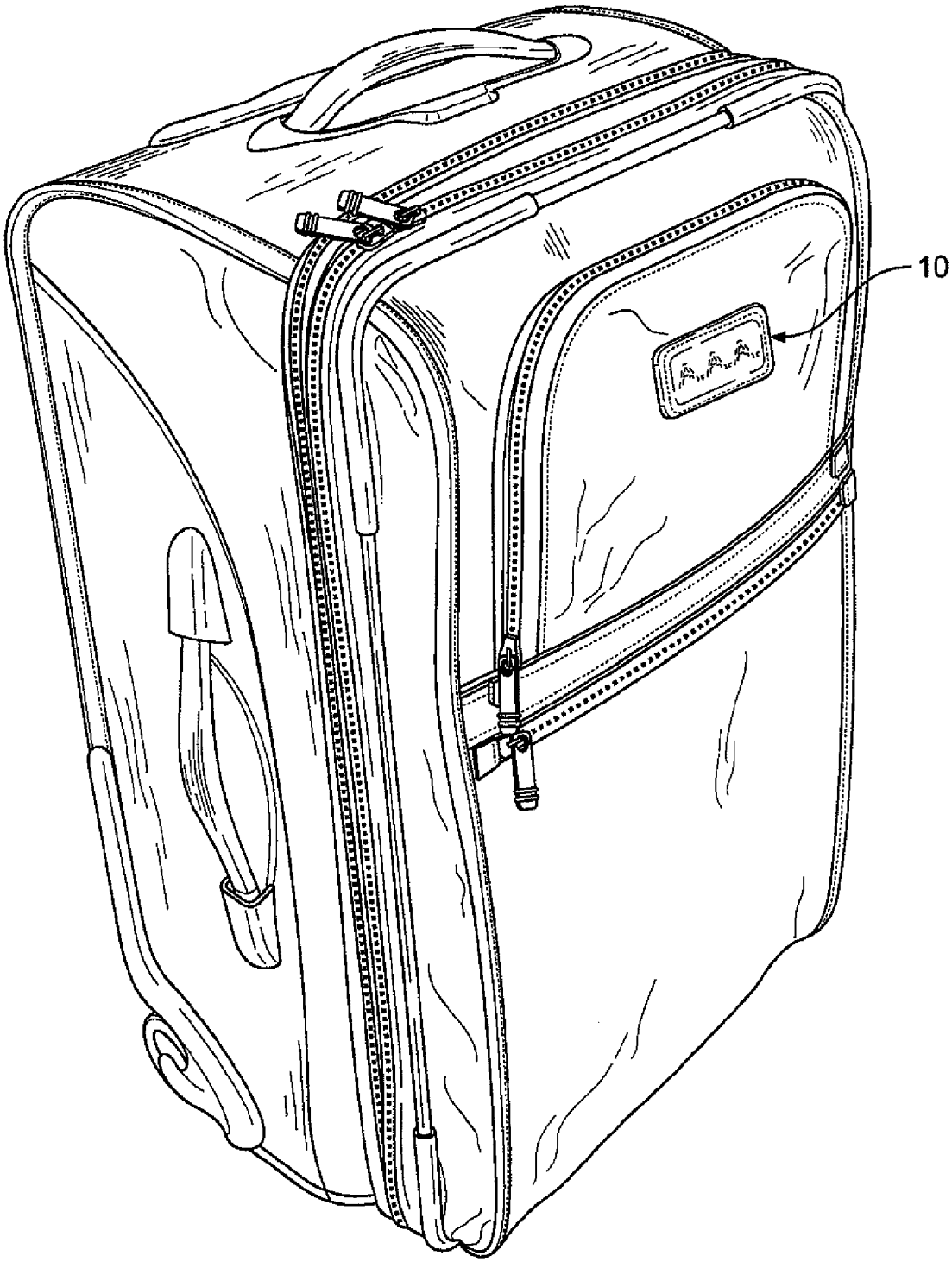
FIG. 1 is a schematic representation of the removable identification patch installed on a first exemplary piece of luggage.

Reference will now be made in detail to the present exemplary embodiments of the invention, an example of which is illustrated in the accompanying drawings. The method and corresponding steps of the invention will be described in conjunction with the detailed description of the system.

The methods and devices presented herein may be used for attaching an identification patch to a piece of luggage. The present invention is particularly suited for incorporating an owner's initials, or other indicia, into a removable identification patch, and attaching the identification patch to a piece of luggage in such a manner that reduces the likelihood of tearing or damage to both the removable identification patch as well the luggage itself. The present invention provides a highly adaptable luggage identification system that can be used on any type, shape or style of luggage. For purpose of explanation and illustration, and not limitation, two exemplary items of luggage are depicted with the removable identification patch of the present invention, designated generally by reference character 10 in FIGS. 1-2, As shown in FIGS. 3A-4B, a first embodiment of the removable initial patch system 10 includes a fastening plate 100 having a generally rectangular shape. In one embodiment, the edges of fastening plate 100 are chamfered such that there are no acute corners of the fastening plate 100 which might snag or puncture the luggage panel to which the fastening plate 100 is attached. Additionally, the fastening plate 100 includes a series of apertures 102 which extend through the fastening plate. The dimensions of the fastening plate 100 are primarily determined by the particular application, i.e. the size and shape of the luggage on which the removable initial patch is to be employed. In one embodiment, the fastening plate 100 has a length of approximately 2.3 inches, a width of approximately 1.4 inches, and a thickness of approximately 0.1 inch; and the apertures 102 have a diameter of approximately 0.25 inch. However, alternative dimensions can be utilized if so desired.

In an exemplary embodiment, the patch 200 is configured with a size and shape that corresponds to the fastening plate 100. Accordingly, removable identification patch 200 includes a series of retention features 202 which correspond in position to the apertures 102 of the fastening plate when the patch 200 and fastening plate 100 are coupled together. The retention features 202, which are illustrated as cavities in FIG. 4B, can be formed with a thread configured to engage the fasteners which are inserted through the apertures 102 to securely attach the fastening plate to the luggage panel, as discussed in further detail below. In an exemplary embodiment, the cavities are configured with a depth that which is less than the thickness of the patch 200.

Similar to the fastening plate 100, the dimensions of the patch 200 are primarily determined by the particular application, i.e., the size and shape of the luggage on which the removable identification patch system is to be employed. In one embodiment, the patch 200 has a length of approximately 2.3 inches, a width of approximately 1.4 inches, and a thickness of approximately 0.4 inch; and the cavities 202 have a diameter of approximately 0.25 inch. However, alternative dimensions can be utilized if so desired.

In accordance with an aspect of the invention, the removable initial patch system 10 allows for indicia (for example, an owner's initials, trademark, slogan, logo, etc.), to be engraved, stitched, printed or otherwise deposited onto the patch 200, prior to installation of the patch onto the luggage panel. Such a modular system 10 is advantageous in that it greatly simplifies the engraving/stitching process such that only the patch 200 need be subjected to the engraving/stitching apparatus.

Figure 2:
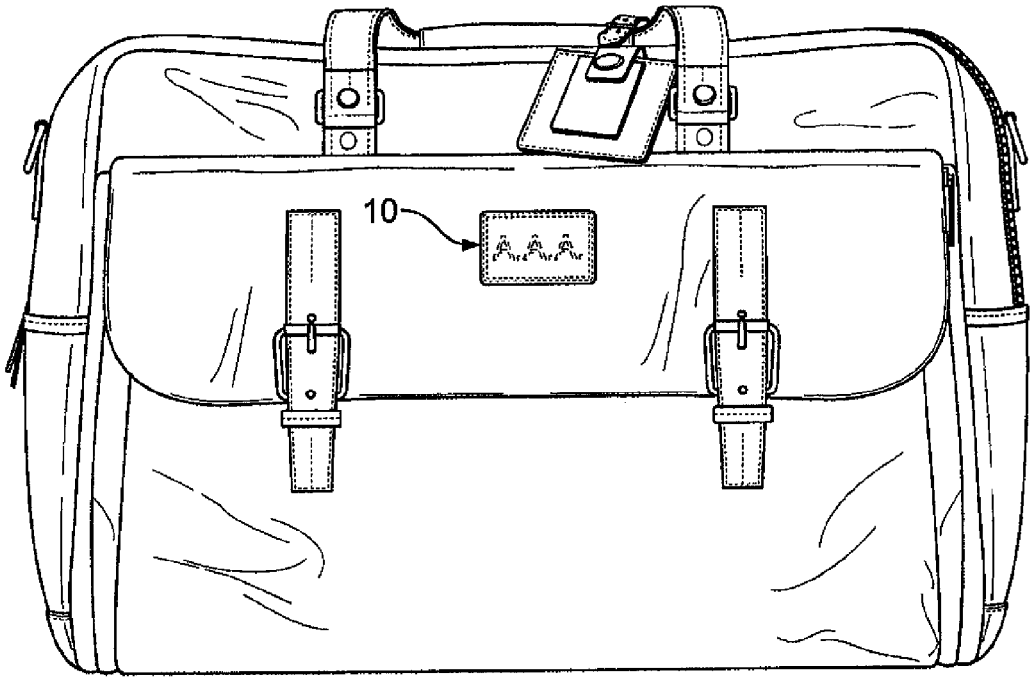
FIG. 2 is a schematic representation of the removable identification patch installed on a second exemplary piece of luggage.
Figure 3A:
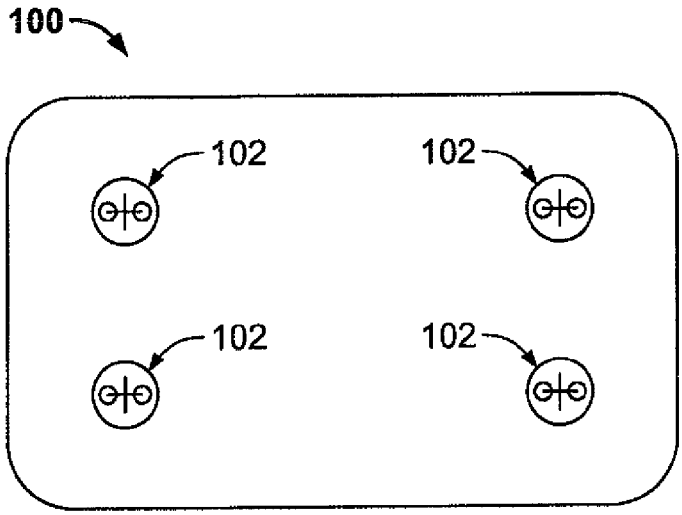
FIG. 3A is a plan view of a first embodiment of the fastening plate in accordance with the invention.
Figure 3B:
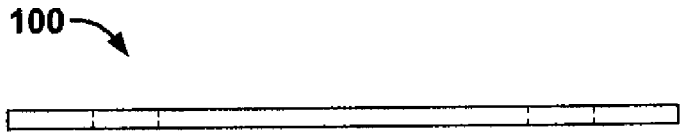
FIG. 3B is a side view of the fastening plate shown in FIG. 3A.
Figure 4A:
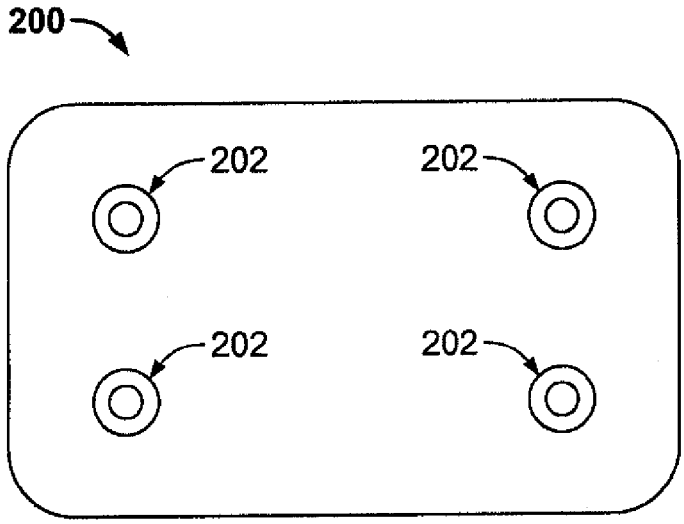
FIG. 4A is a bottom view of a first embodiment of the removable initial patch in accordance with the invention.
Figure 4B:
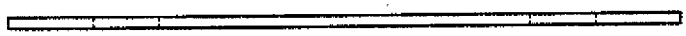
FIG. 4B is a side view of the removable initial patch shown in FIG. 4A.
Figure 5A:
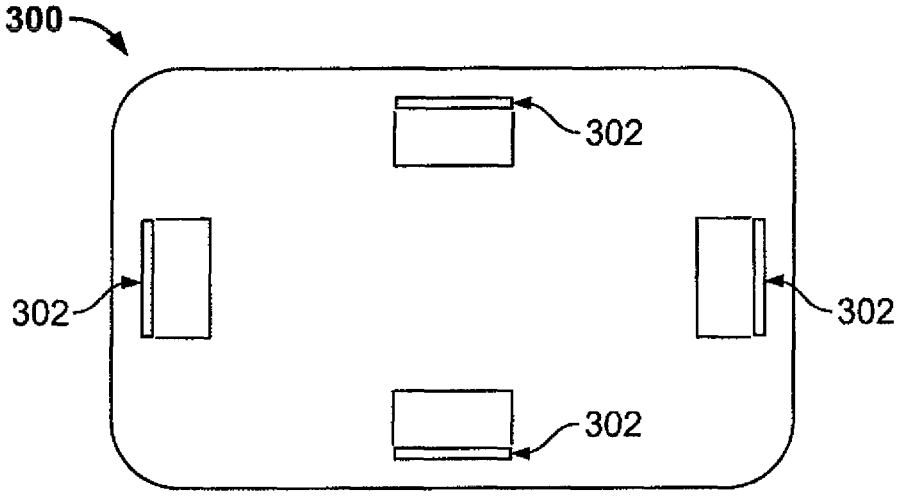
FIG. 5A is a plan view of a second embodiment of the fastening plate in accordance with the invention.
Figure 5B:
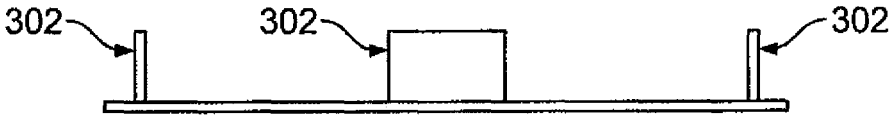
FIG. 5B is a side view of the fastening plate shown in FIG. 5A.
Figure 6A:
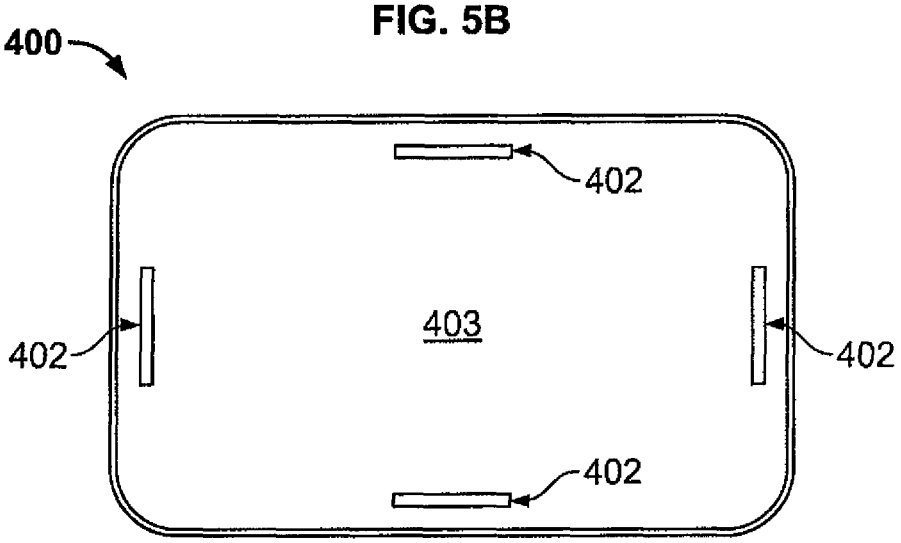
FIG. 6A is a plan view of the housing member in accordance with the invention.
Figure 6B:
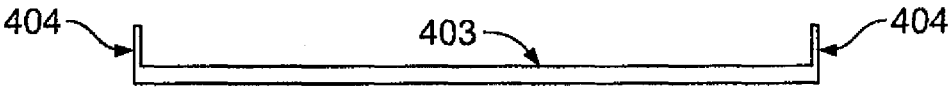
FIG. 6B is a side view of the housing member shown in FIG. 6A.

Conversely, if the patch were permanently affixed to the luggage panel prior to the engraving/stitching operation, the entire piece of luggage would have to be maneuvered into position with respect to the engraving/stitching apparatus. As illustrated in FIGS. 1-2, many luggage items are quite large and cumbersome which might inhibit or preclude proper alignment of the identification patch with respect to the engraving/stitching apparatus. Also, with permanent patches, a misalignment or improper affixing of the identifying indicia could lead to wastage of the entire luggage.

Figure 7:
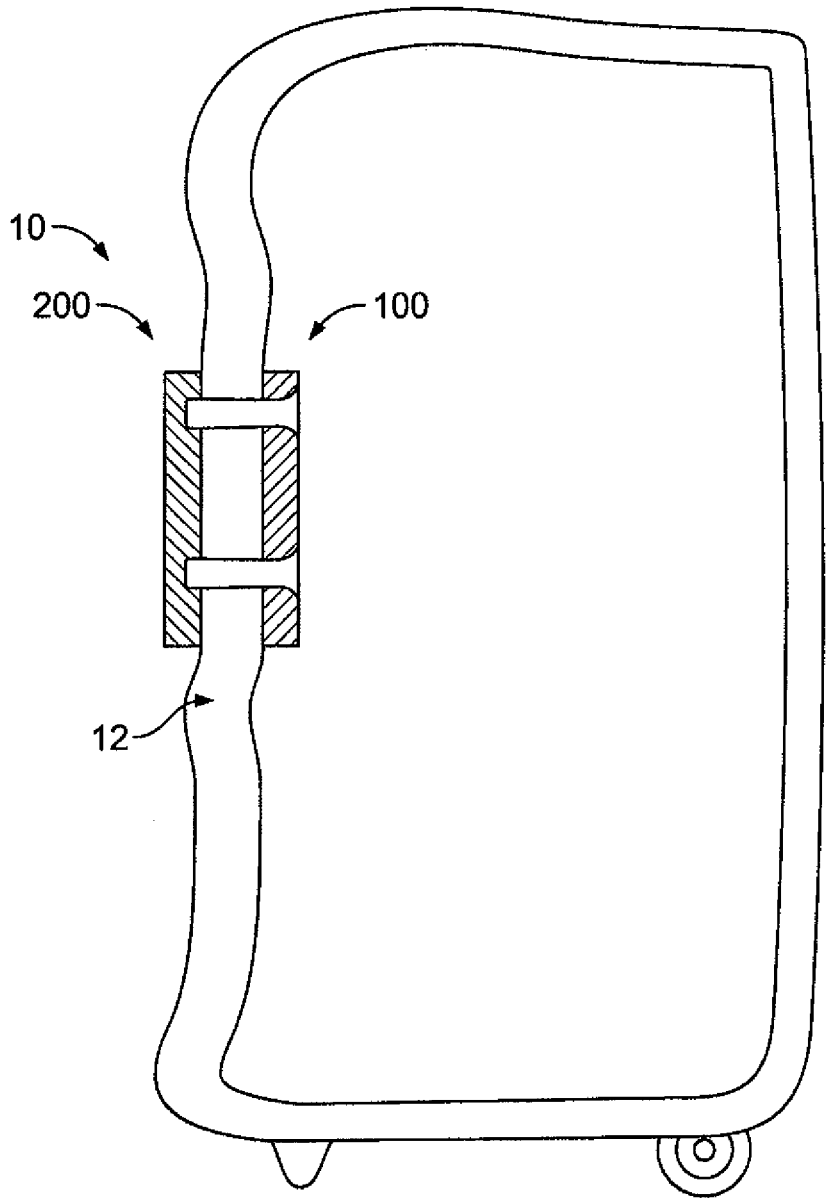
FIG. 7 is a cross-sectional view of the first embodiment of the removable identification patch system of FIGS. 3A-4B.

Accordingly, once the patch 200 is provided with the desired indicia, the removable identification system 10 of the present invention is attached to a panel of the luggage by positioning the fastening plate 100 on an interior surface of the luggage panel, as shown in FIG. 7. The patch 200 is positioned on the exterior surface of the panel, such that the apertures 102 of the fastening plate 100 are aligned with the cavities 202 of the patch 200. Additionally, a series of fasteners are inserted through the apertures 102, and luggage panel 12 to engage the cavities 202 and securely couple the patch 200 to the fastening plate 100.

In an exemplary embodiment, pre-formed holes are provided in the luggage panel in order to reduce the force required for insertion of the fasteners (not shown) into the patch 200. Alternatively, self-tapping fasteners can be utilized which pierce the luggage panel upon insertion of the fastener into the patch 200. Such self-tapping fasteners are advantageous in that they provide greater flexibility in the positioning of the removable identification patch system 10, thereby enhancing customization. Fasteners such as screws, tacks, nails, etc., can be used to securely couple the fastening plate 100 to the patch 200, wherein the luggage panel 12 is disposed therebetween, as shown in FIG. 7. Further, the present invention can be configured such that after installation of the patch system, the fasteners remain accessible from the interior of the luggage panel. Thus, the fasteners can be removed to allow the patch 200 to be removed and replaced with a second patch, if so desired.

In a second embodiment, the removable identification patch system 10 comprises a fastening plate 300, a housing member 400, and a removable identification patch 500, as shown in FIGS. 5A-6B and FIG. 8. In an exemplary embodiment, the fastening plate 300 has a generally rectangular shape with chamfered edges such that there are no acute corners of the fastening plate 300 which might snag or puncture the luggage panel to which the fastening plate 300 is attached. Additionally, the fastening plate 300 includes a series of retention features 302 that protrude from the fastening plate 300, which are illustrated in FIG. 5B as projecting tabs although alternative retention features are considered to be within the scope of the invention.

The dimensions of the fastening plate 300 are primarily determined by the particular application, i.e., the size and shape of the luggage on which the removable initial patch is to be employed. In one embodiment, the fastening plate 300 has a length of approximately 2.3 inches, a width of approximately 1.4 inches, and a thickness of approximately 0.03 inch; and the retention features 302 having a length of approximately 0.25 inch. However, alternative dimensions can be utilized if so desired.

Additionally, a housing member 400 is provided which serves as an intermediate member disposed between and matingly engaging both the fastening plate 300, and the patch 500. Accordingly, housing member 400 is preferably configured with a size and shape which corresponds to the fastening plate 300 and patch 500. Housing member 400 includes generally planar surface 403 having a series of apertures 402 which are arranged to correspond with the projecting tabs 302, when the fastening plate 300 and housing member 400 are coupled together. Further, the housing member 400 is provided with a boundary edge 404 which projects beyond planar surface 403 to define a cavity within the housing for receiving the patch 500. This is beneficial since the housing is typically made of a rigid material which will protect the patch 500 from damage during usage and mishandling of the luggage.

Similar to the fastening plate 300, the dimensions of the housing member 400 are primarily determined by the particular application, i.e., the size and shape of the luggage on which the removable identification patch system is to be employed. In one embodiment, the housing 400 has a length of approximately 2.3 inches, a width of approximately 1.4 inches, and a boundary edge 404 which protrudes approximately 0.4 inch from the planar surface 403. However, alternative dimensions can be utilized if so desired. As discussed above, the housing member is ideally configured to receive the patch 500 within the cavity defined therein.

In an exemplary embodiment, the patch 500 is configured with a size and shape that corresponds to the fastening plate 300 and housing member 400. Additionally, the patch 500 is disposed within the cavity of the housing member and can be affixed therein with an adhesive. The adhesive employed can provide a sufficient bond such that the patch 500 is permanently, or near permanently, adhered to the housing member 400. Alternatively, the patch 500 can be attached to the housing via an interference fit between the boundary edge 404 of the housing member and the outer periphery of the patch 500 thereby allowing for the patch 500 to be removed, if so desired. In an exemplary embodiment, the boundary edge 404 of the housing member projects a distance to define a cavity having sufficient depth to surround the entire outer periphery of the patch 500. In other words, the patch 500 can be positioned within the housing member cavity such that the top surface of the patch is in-plane, or lies flush, with the boundary edge 404. This is beneficial in inhibiting any damage or scratches to the exterior of the patch 500.

Similar to the fastening plate 300, the dimensions of the patch 500 are primarily determined by the particular application, i.e., the size and shape of the luggage on which the removable identification patch system is to be employed. In one embodiment, the patch 500 has a length of approximately 2.3 inches, a width of approximately 1.4 inches, and a thickness of approximately 0.4 inch. However, alternative dimensions can be utilized if so desired.

As discussed above in regards to the embodiment of FIGS. 3A-4B, and in accordance with an aspect of the invention, the removable initial patch system 10 allows for indicia (for example, an owner's initials, trademark, slogan, logo, etc.), to be engraved, stitched, printed or otherwise deposited onto the patch 200, prior to installation of the patch onto the luggage panel.

Figure 8:
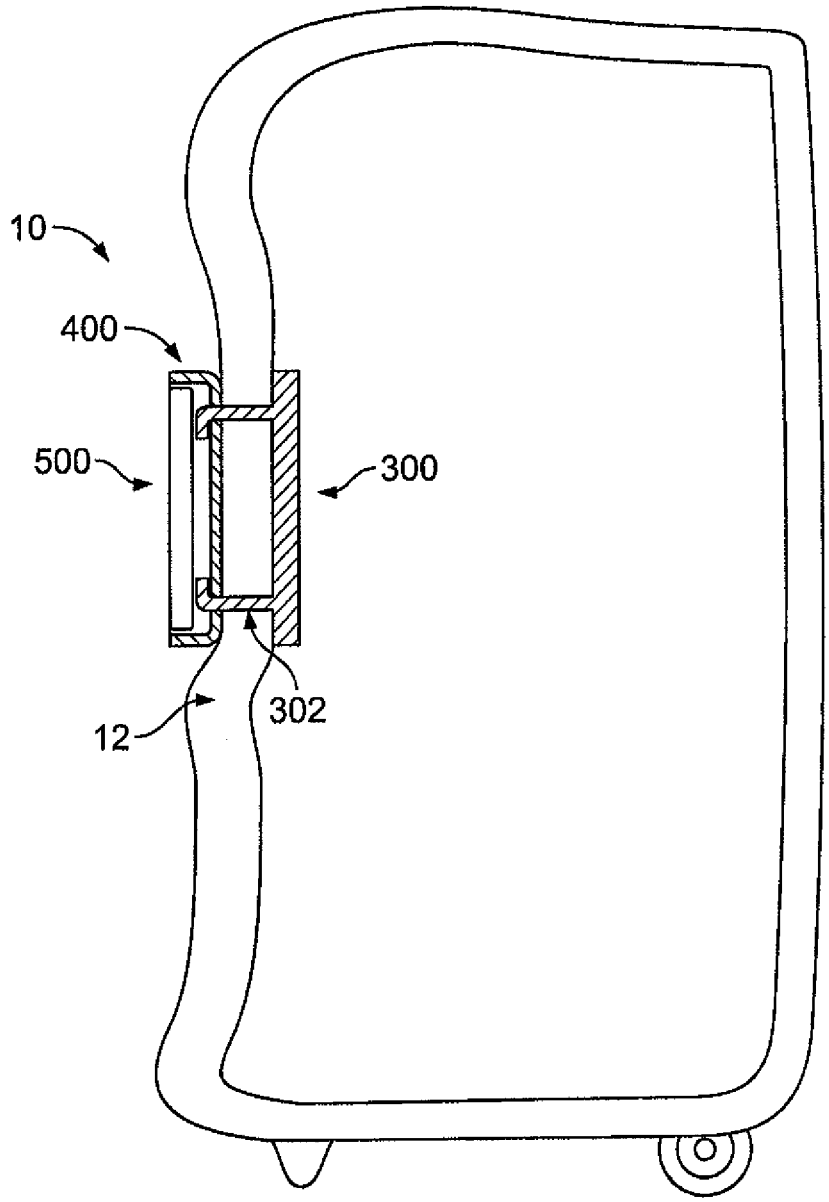
FIG. 8 is a cross-sectional view of the second embodiment of the removable identification patch system of FIGS. 5A-6B.

Accordingly, once the patch 500 is provided with the desired indicia, the removable identification system 10 of the present invention is attached to a panel of the luggage by positioning the fastening plate 300 on an interior surface of the luggage panel, as shown in FIG. 8. The housing member 400 is positioned on the exterior surface of the panel, such that the projecting tabs 302 of the fastening plate 300 are aligned with the apertures 402 of the housing member 400. In an exemplary embodiment, the projecting tabs 302 are inserted through the luggage panel 12 and apertures 402, and bent towards the center of the housing 400 to securely couple the fastening plate 300 to the housing member 400.

Projecting tabs 302 provide sufficient rigidity to ensure a secure attachment between the fastening plate 300 and the housing member 400, while maintaining enough flexibility to allow the housing member 400 to be detached from the fastening plate upon application of adequate force. This feature protects the luggage panel from accidental tearing in the event the identification patch system 10 is subjected to an abrupt force during usage or mishandling of the luggage. Instead, the projecting tabs 302 will give way and deform according to the forces applied, allowing the patch 500 and housing 400 assembly disposed on the exterior of the luggage panel 12 to disengage from the fastening plate 300 on the interior of the luggage panel 12.

In an exemplary embodiment, pre-formed holes or slots are provided in the luggage panel 12 in order to reduce the force required for insertion of the projecting tabs 402 through luggage panel 12 and into the apertures 402. Alternatively, the projecting tabs can pierce the luggage panel 12 upon application of sufficient force to the housing member 400. Such self-piercing projecting tabs 402 are advantageous in that they provide greater flexibility in the positioning of the removable identification patch system 10, thereby enhancing customization.

Although a wide variety of materials can be employed in accordance with the present invention, in an exemplary embodiment the fastening plates 100, 300 and the housing member 400 are made of metal, while the patch 200, 500 are made of leather.

While the present invention is described herein in terms of certain exemplary embodiments, those skilled in the art will recognize that various modifications and improvements may be made to the invention without departing from the scope thereof. For example, while the invention is illustrated primarily in terms of a removable identification patch, in which the patch may be applied to various luggage designs and at various locations on a piece of luggage. Moreover, although individual features of one embodiment of the invention may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the invention is also directed to other embodiments having any other possible combination of the dependent features claimed below and those disclosed above. As such, the particular features presented in the dependent claims and disclosed above can be combined with each other in other manners within the scope of the invention such that the invention should be recognized as also specifically directed to other embodiments having any other possible combinations. Thus, the foregoing description of specific embodiments of the invention has been presented for purposes of illustration and description. It is not intended to be exhaustive or to limit the invention to those embodiments disclosed.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

The invention claimed is:

1. A method for personalizing luggage, comprising:

providing a piece of luggage;

securing a fastening member to the piece of luggage, the fastening member extending through a surface of the luggage and including at least one retention feature;

coupling a housing to the fastening member, the housing comprising a generally planar surface with a raised border extending around the periphery of the generally planar surface to define a cavity therein;

aligning an identification patch with at least one of an engraving apparatus or a stitching apparatus;

forming indicia on the identification patch using the engraving or stitching apparatus; and removably coupling the identification patch having the indicia to the housing, wherein the identification patch is disposed within the cavity with a surface of the identification patch coplanar with the raised border;

wherein the fastening member is disposed on an interior surface of the luggage;

wherein the housing and the identification patch are disposed on an exterior surface of the luggage; and wherein the at least one retention feature comprises a projecting tab having flexibility to give way and deform to allow the housing to detach from the fastening member upon application of less force than would be required to tear the luggage.

2. The method of claim 1, wherein the housing includes at least one aperture, and coupling the housing to the fastening member includes inserting the at least one retention feature through the at least one aperture.

3. The method of claim 1, wherein the at least one retention feature is configured as a projecting tab.

4. The method of claim 1, further comprising:

forming second indicia on a second identification patch;

removing the coupled identification patch from the housing; and removably coupling the second identification patch having the second indicia to the housing.

5. The method of claim 1, wherein the fastening member comprises metal.

6. The method of claim 1, wherein the housing comprises metal.

7. The method of claim 1, wherein the identification patch comprises leather.

* * * * *